US009453628B2

(12) United States Patent
Fedosik et al.

(10) Patent No.: US 9,453,628 B2
(45) Date of Patent: Sep. 27, 2016

(54) HEADLIGHT LENS FOR A VEHICLE HEADLIGHT

(75) Inventors: Dmitry Fedosik, Jena (DE); Wolfram Wintzer, Jena (DE)

(73) Assignee: Docter Optics SE, Neustadt an der Orla (DE)

( * ) Notice: Subject to any disclaimer, the term of this patent is extended or adjusted under 35 U.S.C. 154(b) by 615 days.

(21) Appl. No.: 13/990,085

(22) PCT Filed: Nov. 11, 2011

(86) PCT No.: PCT/EP2011/005702

§ 371 (c)(1),
(2), (4) Date: Jul. 3, 2013

(87) PCT Pub. No.: WO2012/072192

PCT Pub. Date: Jun. 7, 2012

(65) Prior Publication Data

US 2013/0272011 A1 Oct. 17, 2013

(30) Foreign Application Priority Data

Dec. 3, 2010 (DE) ..... 10 2010 053 185
Feb. 1, 2011 (DE) ..... 10 2011 009 950
Jul. 11, 2011 (DE) ..... 10 2011 107 058

(51) Int. Cl.
*F21S 8/10* (2006.01)

(52) U.S. Cl.
CPC ..... *F21S 48/1225* (2013.01); *F21S 48/1159* (2013.01); *F21S 48/1163* (2013.01); *F21S 48/12* (2013.01); *F21S 48/1241* (2013.01); *F21S 48/1266* (2013.01); *F21S 48/1275* (2013.01)

(58) Field of Classification Search
CPC ..... F21S 48/1241; F21S 48/1159; F21S 48/1275; F21S 48/1225; F21S 48/1291; F21S 48/115; F21S 48/1266; F21S 48/1163; F21S 48/12; F21S 48/125; F21S 48/1747; F21S 48/1154; G02B 19/0061; G02B 3/04; G02B 6/0018; F21Y 2101/02; B29L 2011/0016; B29L 2031/3055; B60Q 1/0041; B60Q 1/0047; F21V 5/04; F21W 2101/10
See application file for complete search history.

(56) References Cited

U.S. PATENT DOCUMENTS 5,257,168 A 10/1993 Davenport et al.
5,697,690 A 12/1997 Okuchi et al.

(Continued)

FOREIGN PATENT DOCUMENTS

DE 1165514 B 9/1964
DE 4121673 A1 1/1993

(Continued)

OTHER PUBLICATIONS

PCT International Search Report completed by the ISA/EP on Feb. 1, 2012 and issued in connection with PCT/EP2011/005698.

(Continued)

*Primary Examiner* — Evan Dzierzynski
*Assistant Examiner* — Danielle Allen
(74) *Attorney, Agent, or Firm* — Barnes & Thornburg LLP

(57) ABSTRACT

Vehicle headlight comprising a monolithic body of transparent material, the monolithic body including at least one light entry face, a light passage section and at least one optically operative light exit face. The Vehicle headlight further comprises a light source for irradiating light into the light entry face.

25 Claims, 13 Drawing Sheets

(56) References Cited

U.S. PATENT DOCUMENTS

| | | | | |
|---|---|---|---|---|
| 6,709,141 | B1 | 3/2004 | Sisti | |
| 7,073,931 | B2 | 7/2006 | Ishida | |
| 7,207,705 | B2 * | 4/2007 | Ishida | F21S 48/1159 362/298 |
| 7,654,714 | B2 | 2/2010 | Mochizuki et al. | |
| 8,342,726 | B2 | 1/2013 | Fischer et al. | |
| 2004/0156209 | A1 | 8/2004 | Ishida | |
| 2006/0087860 | A1 | 4/2006 | Ishida | |
| 2006/0126353 | A1 | 6/2006 | Ishida | |
| 2007/0147055 | A1 | 6/2007 | Komatsu | |
| 2007/0201241 | A1 | 8/2007 | Komatsu | |
| 2010/0033849 | A1 | 2/2010 | Seki et al. | |
| 2011/0148280 | A1 | 6/2011 | Kishimoto et al. | |

FOREIGN PATENT DOCUMENTS

| | | | |
|---|---|---|---|
| DE | 4209957 | A1 | 9/1993 |
| DE | 4320554 | A1 | 12/1993 |
| DE | 19526512 | A1 | 1/1996 |
| DE | 19742159 | A1 | 4/1998 |
| DE | 102005011760 | A1 | 9/2006 |
| DE | 102008026626 | A1 | 12/2009 |
| DE | 10252228 | B4 | 1/2010 |
| DE | 102008049168 | A1 | 4/2010 |
| DE | 102009008631 | A1 | 8/2010 |
| EP | 1113216 | A2 | 7/2001 |
| EP | 1357334 | A1 | 10/2003 |
| EP | 1666787 | A1 | 6/2006 |
| EP | 1500869 | B1 | 8/2006 |
| EP | 1767398 | A1 | 3/2007 |
| EP | 2113222 | A1 | 11/2009 |
| EP | 2159479 | A2 | 3/2010 |
| EP | 2221219 | A1 | 8/2010 |
| FR | 2860280 | A1 | 9/2004 |
| GB | 2365962 | A | 2/2002 |
| GB | 2399622 | B | 8/2005 |
| GB | 2412159 | A | 9/2005 |
| JP | 2005317226 | | 11/2005 |
| WO | 2009/147070 | A1 | 12/2009 |

OTHER PUBLICATIONS

PCT International Search Report completed by the ISA/EP on Mar. 19, 2012 and issued in connection with PCT/EP2011/005699.

PCT International Search Report completed by the ISA/EP on Feb. 15, 2012 and issued in connection with PCT/EP2011/005700.

PCT International Search Report completed by the ISA/EP on Feb. 1, 2012 and issued in connection with PCT/EP2011/005701.

PCT International Search Report completed by the ISA/EP on May 9, 2012 and issued in connection with PCT/EP2011/005702.

PCT International Search Report completed by the ISA/EP on May 4, 2012 and issued in connection with PCT/EP2011/005703.

International Preliminary Report on Patentability (Chapter I) issued on Jun. 4, 2013 in connection with PCT/EP2011/005698.

International Preliminary Report on Patentability (Chapter I) issued on Jun. 4, 2013 in connection with PCT/EP2011/005699.

International Preliminary Report on Patentability (Chapter I) issued on Jun. 4, 2013 in connection with PCT/EP2011/005700.

International Preliminary Report on Patentability (Chapter I) issued on Jun. 4, 2013 in connection with PCT/EP2011/005701.

International Preliminary Report on Patentability (Chapter I) issued on Jun. 4, 2013 in connection with PCT/EP2011/005702.

International Preliminary Report on Patentability (Chapter I) issued on Jun. 4, 2013 in connection with PCT/EP2011/005703.

* cited by examiner

Fig. 10
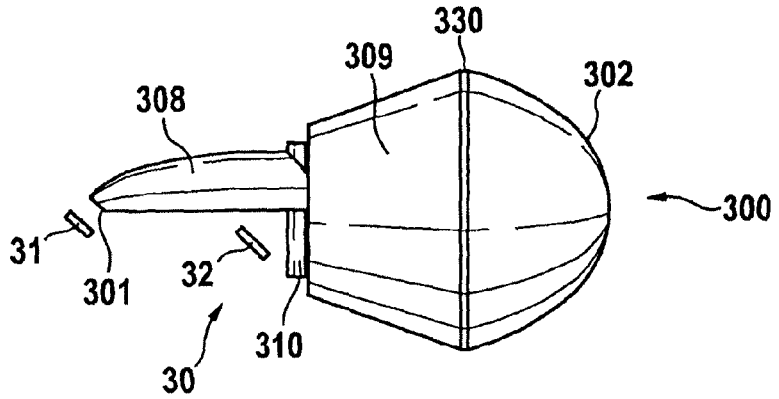
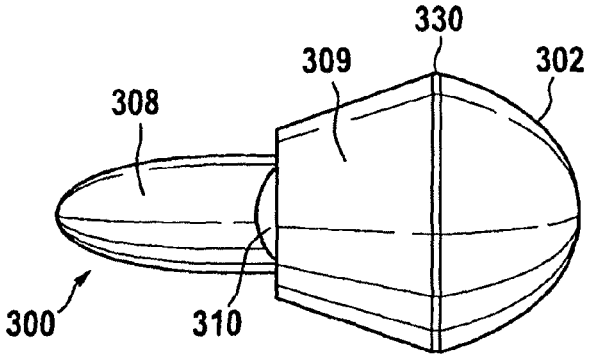
Fig. 11
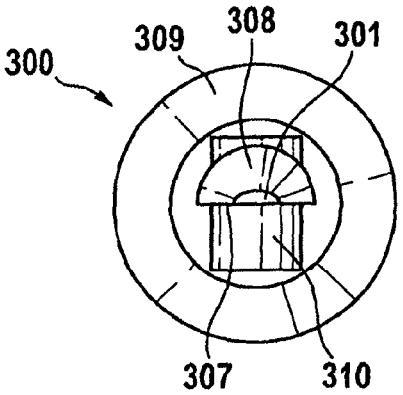
Fig. 12
Fig. 13
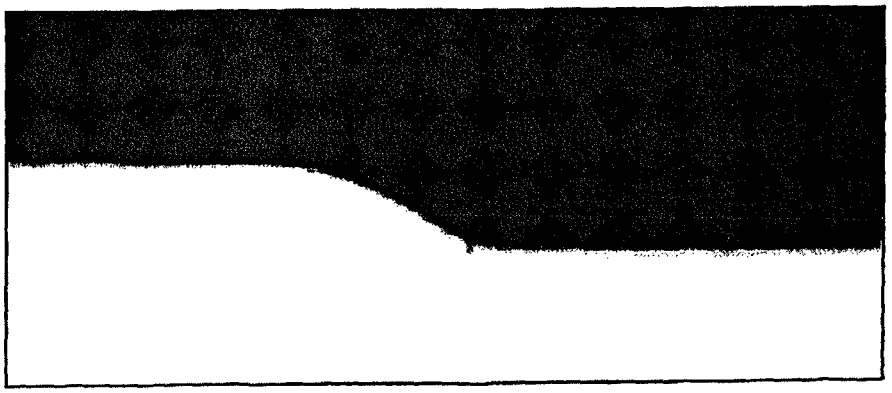

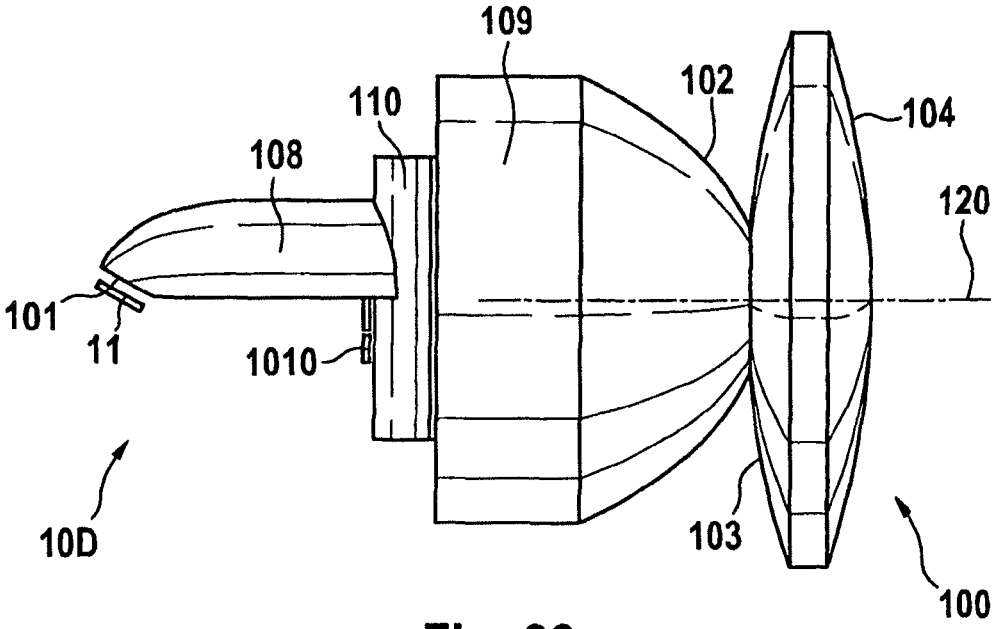
Fig. 22
Fig. 23
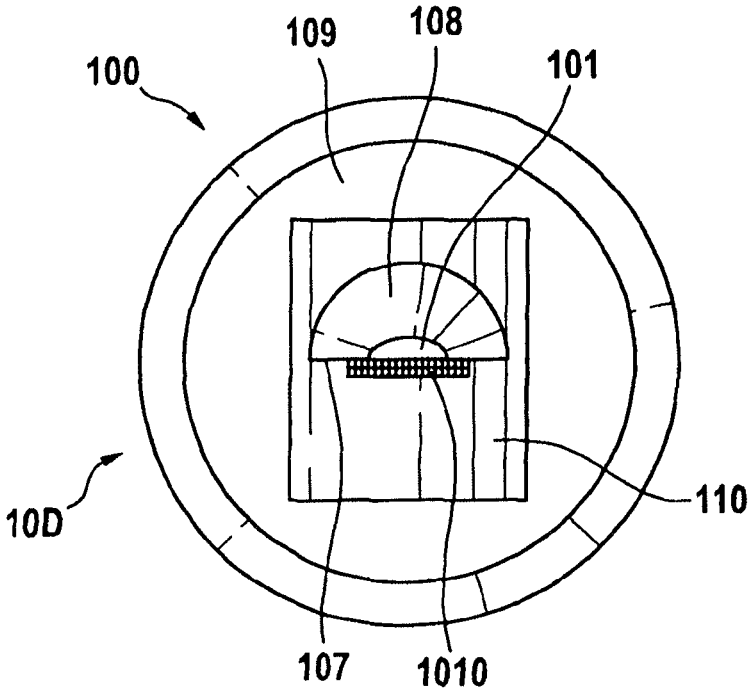

HEADLIGHT LENS FOR A VEHICLE HEADLIGHT

CROSS-REFERENCE TO RELATED APPLICATIONS

This application is the U.S. national phase of PCT/EP2011/005702 filed Nov. 11, 2011. PCT/EP2011/005702 claims the benefit under the Convention of German Patent Application Nos. 10 2010 053 185.5, 10 2011 009 950.6, and 10 2011 107 058.7 filed Dec. 3, 2010, Feb. 1, 2011, and Jul. 11, 2011 (respectively).

FIELD OF THE INVENTION

The invention relates to a vehicle headlight, in particular to a motor vehicle headlight, including a headlight lens which comprises a monolithic body of transparent material including at least one light entry face and at least one optically operative (also to be understood as 'effective') light exit face.

BACKGROUND INFORMATION

DE 203 20 546 U1 discloses a lens blank-molded on both sides and having a curved surface, a planar surface and a retention edge integrally molded onto the lens' edge, wherein a supporting edge of a thickness of at least 0.2 mm and projecting with respect to the planar surface is integrally formed onto the retention edge. Herein, the supporting edge is integrally formed onto the outer circumference of the headlight lens. A further headlight lens having a supporting edge is disclosed e.g. by DE 10 2004 048 500 A1.

DE 20 2004 005 936 U1 discloses a lens for illuminating purposes, notably a lens for a headlight for imaging light emitted from a light source and reflected by a reflector for generating a predetermined illumination pattern, said lens including two opposing surfaces, wherein areas of different optical dispersion effects are provided on at least a first surface.

DE 103 15 131 A1 discloses a headlight for vehicles including at least one extensive luminous field including a plurality of illuminating element (diode)-chips and an optical element arranged in the light path of the light beam emitted by the luminous field, wherein the illuminating element chips of the luminous field are arranged in a common recess, and that the recess, on a side facing the direction of light emission, has an outer edge which, in relation to the elimination element chips, is spatially arranged such that a predetermined gradient of light density is formed in a light dispersion of the headlight in the area of the outer edges.

DE 10 2004 043 706 A1 discloses an optical system for a motor vehicle headlight for dispersing a beam of light rays from an illuminant, with an optical primary element having an optical face including a break or discontinuity extending along a line, being provided, wherein the optical face is formed to be smooth at least on one side adjacent the discontinuity so that the beam of light rays is separated into two partial beams of light rays. Herein, it is provided that at least one of the partial beams of light rays has a sharp edge of limitation. Moreover, the optical system comprises an optical secondary element for mapping the sharp edge of limitation on to a predetermined light-dark-boundary.

EP 1 357 333 A2 discloses a light source device for a vehicle light which has an element emitting semiconductor light, which element is arranged on an optical axis of the light source device and emits its light essentially in an orthogonal direction with regard to the optical axis.

Further illumination facilities in context with vehicles are disclosed by DE 42 09 957 A1, DE 41 21 673 A1, DE 43 20 554 A1, DE 195 26 512 A1, DE 10 2009 008 631 A1, U.S. Pat. Nos. 5,257,168 and 5,697,690.

It is, in particular, an object of the invention to suggest an improved headlight lens for a vehicle headlight, in particular for a motor vehicle headlight. It is a further object of the invention to reduce the costs for manufacturing vehicle headlights.

SUMMARY

The aforementioned object is achieved by a vehicle headlight, in particular motor vehicle headlight, including at least one first light source and a headlight lens which comprises a particularly blank-molded monolithic (solid) body of transparent material, wherein the monolithic body comprises at least one light tunnel and one light passage section (light conductive section) including at least one optically operative light exit (sur)face, wherein the light tunnel comprises at least one in particular optically operative (first) light entry (sur)face and, via a bend, passes over (transits) into the light passage section for imaging the bend as a light-dark-boundary (bright-dark-boundary) by means of light from the first light source made to enter or irradiated, respectively, into the (first) light entry face.

An optically operative (also termed 'effective') light entry face or an optically operative (also 'effective') light exit face are (constituted by) an optically operative surface of the monolithic body. In the sense of the invention, an optically operative surface is, in particular, a surface of the transparent body, at which surface, when using the headlight lens according to its purpose light will be refracted. In the sense of the invention an optically operative surface is in particular a surface at which, when using the headlight lens according to its purpose, the direction of light which passes through this surface will be changed.

In the sense of the invention, transparent material is particularly glass. In the sense of the invention, transparent material is particularly inorganic glass. In the sense of the invention, transparent material is particularly silicate glass. In the sense of the invention, transparent material is particularly glass as described in document PCT/EP2008/010136. In the sense of the invention, glass particularly comprises 0.2 to 2% by weight $Al_2O_3$,
0.1 to 1% by weight $Li_2O$,
0.3 (in particular 0.4) to 1.5% by weight $Sb_2O_3$,
60 to 75% by weight $SiO_2$,
3 to 12% by weight $Na_2O$,
3 to 12% by weight $K_2O$, and
3 to 12% by weight CaO.

In the sense of the invention, the term blank-molding is, in particular, to be understood in a manner that an optically operative surface is to be molded under pressure such that any subsequent finishing or post-treatment of the contour of this optically operative surface may be dispensed with or does not apply or will not have to be provided for, respectively. Consequently, it is particularly provided for that, after blank-molding, a blank-molded surface is not ground, i.e. it need not be treated by grinding.

In the sense of the invention a light tunnel is in particular characterized in that, taken essentially, total reflection occurs at its lateral (in particular upper, lower, right and or left) surfaces, so that light entering the light entry face is guided through the tunnel as a light guide. In the sense of the invention a light tunnel is in particular a light guide or light conductor. In particular, it is provided for that total reflection is to occur on the longitudinal surfaces of the light tunnel. In particular, it is provided for that the longitudinal surfaces of the light tunnel are adapted for total reflection. In particular, it is provided for that total reflection is to occur at the surfaces of the light tunnel essentially oriented in the direction of the optical axis of the light tunnel. In particular, it is provided for that the surfaces of the light tunnel essentially oriented in the direction of the optical axis of the light tunnel are adapted for total reflection. A light tunnel, in the sense of the invention, in particular tapers in the direction of its light entry face. A light tunnel, in the sense of the invention, in particular tapers in the direction towards its light entry face by at least 3°. A light tunnel, in the sense of the invention, in particular tapers in the direction towards its light entry face by at least 3° with respect to its optical axis. A light tunnel, in the sense of the invention, in particular tapers at least partially in the direction towards its light entry face. A light tunnel, in the sense of the invention, in particular tapers at least partially in the direction towards its light entry face by at least 3°. A light tunnel, in the sense of the invention, in particular tapers at least partially in the direction towards its light entry face by at least 3° with respect to its optical axis.

A bend, in the sense of the invention, is, in particular, a curved transition. A bend, in the sense of the invention, is, in particular, a curved transition having a radius of curvature of no less than 50 nm. It is, in particular, provided for that the surface of the headlight lens has no break or discontinuity in the bend, but is rather in the shape of a curve or curvature. It is, in particular, provided for that the surface of the headlight lens in the bend has a curvature, in particular with a radius of curvature of the curve in the bend of no less than 50 nm. In an embodiment the radius of curvature is no larger than 5 mm. In an expedient embodiment the radius of curvature is no more than 0.25 mm, in particular no more than 0.15 mm, in particular no more than 0.1 mm. In another embodiment of the invention, the radius of curvature of the curve in the bend is at least 0.05 mm. It is, in particular, provided for that the surface of the headlight lens is blank-molded in the region of the bend.

In another embodiment of the invention the (first) light source and the (first) light entry face are configured and associated with each other such that light of the (first) light source enters the (first) light entry face at a luminous flux density of at least 75 lm/mm$^2$.

In another embodiment of the invention the light tunnel is arranged between the bend and the light entry face. In another embodiment of the invention the light passage section is arranged between the bend and the light exit face. In particular, it is provided for that light, which enters the transparent body through the light entry face and enters the passage section from the light tunnel in the area of the bend will exit from the light exit face at an angle of between −20° and 20° with regard to the optical axis. In particular, it is provided for that light which enters the transparent body through the light entry face will exit from the light exit face at an angle of between −20° and 20° with regard to the optical axis. In particular, it is provided for that light which enters the transparent body through the light entry face and enters the passage section from the light tunnel in the area of the bend, will exit from the light exit face essentially in parallel to the optical axis. It is, in particular, provided for that light, which enters the transparent body through the light entry face will exit from the light exit face essentially in parallel to the optical axis.

In another embodiment of the invention the bend includes an opening angle of at least 90°. In a further expedient embodiment of the invention the bend includes an opening angle of no more than 150°. In a further favourable embodiment of the invention the bend is arranged on a surface of the light passage section, which surface is facing the light entry face.

In another embodiment of the invention the orthogonal of the light entry face is inclined with respect to the optical axis of the light passage section. In a further expedient embodiment of the invention the light entry face is inclined with respect to the optical axis of the light passage section at an angle of between 5° and 70°, in particular at an angle of between 20° and 50°.

In another embodiment of the invention the light tunnel comprises a region on its surface which corresponds essentially to a part of the surface of an ellipsoid. In a further expedient embodiment of the invention the light tunnel comprises a region on its surface which corresponds essentially to at least 15% of the surface of an ellipsoid.

In another embodiment of the invention the light tunnel comprises a region on its surface, for which the following applies:

$$0{,}75\cdot a\cdot\sqrt{1-\frac{y^2}{b^2}-\frac{z^2}{c^2}}\le x\le 1{,}25\cdot a\cdot\sqrt{1-\frac{y^2}{b^2}-\frac{z^2}{c^2}}$$

$$0{,}75\cdot b\cdot\sqrt{1-\frac{x^2}{a^2}-\frac{z^2}{c^2}}\le y\le 1{,}25\cdot b\cdot\sqrt{1-\frac{x^2}{a^2}-\frac{z^2}{c^2}},$$

in which z is a coordinate in the direction (of the optical axis) of the light tunnel;

x is a coordinate orthogonal to the direction of the optical axis of the light tunnel;

y is a coordinate orthogonal to the direction of the optical axis of the light tunnel;

a is a number having a value greater than 0;

b is a number having a value greater than 0; and c is a number having a value greater than 0.

In another embodiment of the invention a surface of the light passage section facing the light tunnel is curved at least in the region of the bend to the transition into the light tunnel, the curvature being, in particular, convex. In another embodiment of the invention the bend is curved in its longitudinal extension. In another embodiment of the invention the bend is curved, in its longitudinal extension, having a radius of curvature of between 5 mm and 100 mm. In another embodiment of the invention the bend is curved, in its longitudinal extension, according to a Petzval curvature (also termed Petzval surface).

In a further expedient embodiment of the invention the bend comprises, in its longitudinal extension, a curvature having a radius of curvature in the orientation of the optical axis of the light tunnel and/or of the light passage section. In a yet further embodiment of the invention the radius of curvature is orientated opposite to the light exit face.

In another embodiment of the invention the bend is curved in a first direction and in a second direction. In a further expedient embodiment of the invention the first direction is orthogonal to the second direction. In another embodiment of the invention the bend is curved with a first radius of curvature in a first direction and with a second radius of curvature in a second direction, wherein the second radius of curvature is positioned orthogonal to the first radius of curvature.

In another embodiment a portion of the surface of the passage section facing the light tunnel is configured as a Petzval surface. In another embodiment of the invention the surface of the light passage section facing the light tunnel is, in a region in which it forms a transition into the light tunnel, configured as a Petzval surface.

In another embodiment of the invention the length of the headlight lens, when viewed in the orientation of the optical axis of the light tunnel and/or the light passage section, amounts to no more than 7 cm.

In another embodiment of the invention the headlight lens or the transparent body, respectively, has a further light exit face as well as a further light entry face. In a further expedient embodiment of the invention at least 20% of the light entering the light entry face and exiting through the light exit face will exit through the light exit face after having exited from the monolithic body through the further light exit face and having entered the monolithic body through the further light entry face. In another embodiment of the invention at least 10%, in particular at least 20% of the light entering the light entry face and exiting through the light exit face will exit through the light exit face without having exited from the monolithic body through the further light exit face and without having entered the monolithic body through the further light entry face. In a yet further expedient embodiment of the invention at least 75% of the light entering the light entry face and exiting through the light exit face will exit through the light exit face after having exited from the monolithic body through the further light exit face and having entered the monolithic body through the further light entry face. In another embodiment of the invention it is provided for that light which enters the transparent body through the light entry face and enters the passage section from the light tunnel in the region of the bend will either exit from the monolithic body from the further light exit face and enter the further light entry face of the monolithic body as well as it will exit from the monolithic body from the light exit face, or it will exit directly from the light exit face (without exiting from the monolithic body through the further light exit face and entering the further light entry face of the monolithic body).

In a further expedient embodiment of the invention the vehicle headlight has no secondary optic associated with the headlight lens. A secondary optic, in the sense of the invention, is in particular an optic for aligning light which exits from the light exit face or from the last light exit face, respectively. A secondary optic, in the sense of the invention, is in particular an optical element for aligning light separated from and/or subordinated with regard to the headlight lens. A secondary optic, in the sense of the invention, is in particular no cover or protection disc, respectively, but an optical element provided for aligning light. An example of a secondary optic is e.g. a secondary lens as has been disclosed in DE 10 2004 043 706 A1.

In particular, there is provided that the bend which is imaged as light-dark-boundary lies in the lower region of the light tunnel.

In another embodiment of the invention the distance of the light source from the centre of the light exit face, when seen in the orientation of the optical axis of the light tunnel and/or the light passage section amounts to no more than 10 cm. In another embodiment of the invention the length of the vehicle headlight, when seen in the orientation of the optical axis of the light tunnel and/or the light passage section amounts to no more than 10 cm.

In a further expedient embodiment of the invention the vehicle headlight comprises at least one second light source spatially separated from the first light source, for making enter or irradiating, respectively, light into the light tunnel and/or immediately/directly (i.e. in particular without passing through the light tunnel) into the light passage section. It may be provided for that, in the sense of the invention, a second light source comprises several partial light sources. In another embodiment of the invention the vehicle headlight comprises at least one second light source spatially separated from the first light source, for making light enter a surface of the light passage section facing the light tunnel. In a further expedient embodiment of the invention light is irradiated, by means of the second light source, above and/or below the light-dark-boundary.

In another embodiment of the invention the second light source includes a source for light for driving round corners (such light, in the following briefly termed "corner light"), which corner light source is arranged in particularly to the left of the optical axis of the light tunnel and/or above the optical axis of the light tunnel and/or of the light tunnel (as such). In another embodiment of the invention the corner light source is arranged between the (first) light entry face and the light passage section. In a further embodiment of the invention the second light source includes one, in particular one further corner light source, which, in particular, is arranged to the right of the optical axis of the light tunnel and/or above the optical axis of the light tunnel and/or of the light tunnel (as such). In another embodiment of the invention the corner light source is arranged between the (first) light entry face and the light passage section.

In another embodiment of the invention the second light source comprises at least one partial light source arranged above the light tunnel. In another embodiment of the invention the second light source comprises at least two partial light sources arranged above the light tunnel, particularly separated spatially from one another. In another embodiment of the invention the second light source comprises at least one partial light source arranged below the light tunnel. In another embodiment of the invention the second light source comprises at least two partial light sources arranged below the light tunnel, particularly separated spatially from one another. In another embodiment of the invention the partial light source or one or several of the light sources is/are arranged between the (first) light entry face and the light passage portion.

In an embodiment of the invention the first light source, a corner light source and/or a partial light source include/s at least one LED or an array of LEDs. In an expedient embodiment of the invention the light source comprises at least one OLED or an array of OLEDs. For example, the light source may well be a plane luminous field. The light source may also include light element chips as have been disclosed by DE 103 15 131 A1. A light source may also be a laser. A suitable laser has been disclosed in ISAL 2011 Proceedings, page 271ff.

The aforementioned object is moreover achieved by a vehicle headlight—comprising, in particular, one or several of the aforementioned features—, in particular a motor vehicle headlight, wherein the vehicle headlight includes a headlight lens—comprising, in particular, one or several of the aforementioned features—, wherein the headlight lens includes an in particular blank-molded monolithic body of transparent material including an optically operative first light entry face for making light enter a first light tunnel section; at least one, in particular optically operative second light entry face for making light enter a second light tunnel section; and at least one optically operative light exit face, wherein the monolithic body comprises a light tunnel in (to) which the first light tunnel section and the second light tunnel section open out, wherein the light tunnel, via a bend, passes over (transits) into a light passage section for imaging the bend as a bright-dark-boundary, and wherein the vehicle headlight comprises a first light source for making light enter the first light entry face and a second light source for making light enter the second light entry face.

It may be provided for that a light entry face, in the sense of the invention, and/or a light exit face, in the sense of the invention, includes a light dispersing structure. A light dispersing structure, in the sense of the invention, may, for example, be a structure as has been disclosed in DE 10 2005 009 556 A1 and in EP 1 514 148 A1 or EP 1 514 148 B1, respectively. It may be provided for that a light tunnel, in the sense of the invention, is coated. It may be provided for that a light tunnel, in the sense of the invention, is coated with a reflective coating or layer. It may be provided for that, in the sense of the invention, a mirror-like reflective coating is applied to a light tunnel.

In the sense of the invention, a motor vehicle is, in particular, a land vehicle for individual use in road traffic. In the sense of the invention, motor vehicles are, in particular, not restricted to land vehicles including a combustion engine.

Further advantages and details may be taken from the following description of the examples of embodiments.

BRIEF DESCRIPTION OF THE DRAWINGS

FIG. 10 shows a side view of a further alternative example of embodiment of a motor vehicle headlight (for use in the motor vehicle according to FIG. 1);

FIG. 11 shows an example of embodiment of a headlight lens of the motor vehicle headlight according to FIG. 10 by way of a top view;

FIG. 12 shows the headlight lens according to FIG. 11 by way of a rear view;

FIG. 13 shows a light-dark-boundary generated by means of the motor vehicle headlight according to FIG. 10;

FIG. 22 shows a side elevation of a further example of embodiment of a motor vehicle headlight for use in the motor vehicle according to FIG. 1;

FIG. 23 shows a view from the rear of the motor vehicle headlight according to FIG. 22;

DETAILED DESCRIPTION

Figure 1:
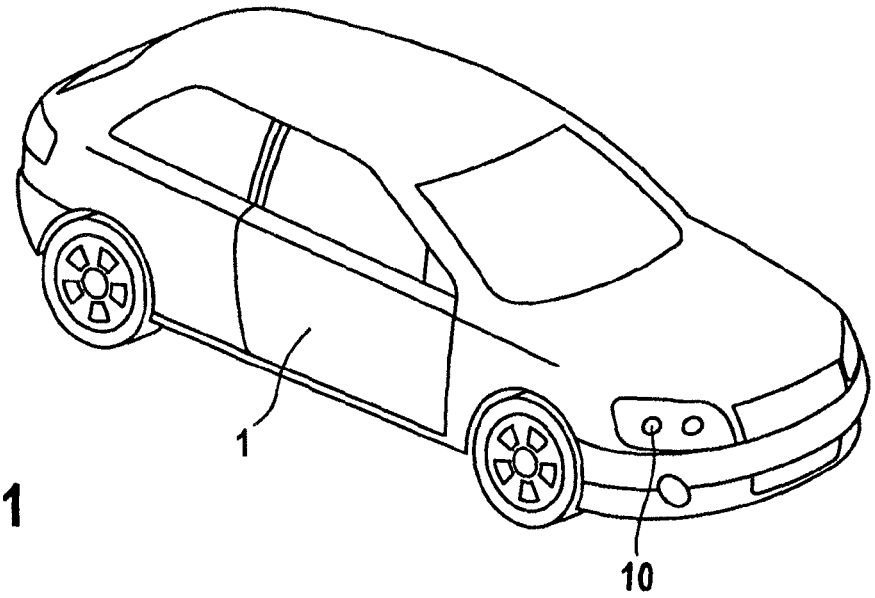
FIG. 1 shows an example of an embodiment of a motor vehicle.
Figure 2:
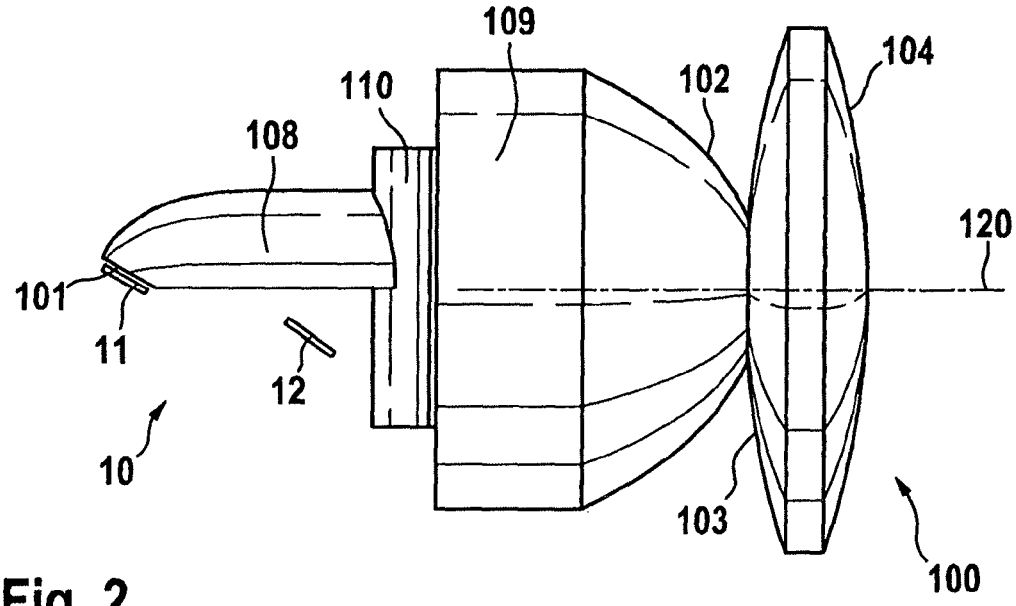
FIG. 2 shows an example of an embodiment of a headlight lens for use in the motor vehicle according to FIG. 1.
Figure 3:
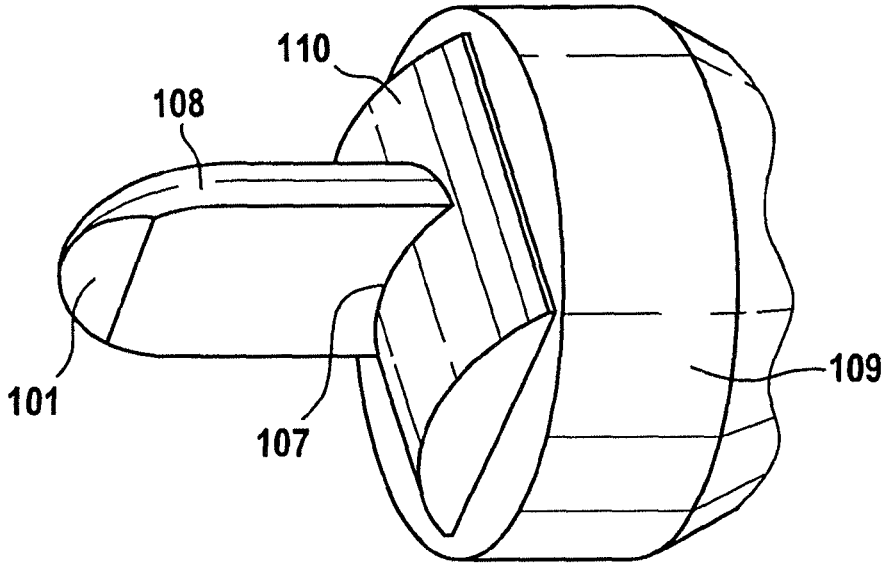
FIG. 3 shows a cut-out representation of a headlight lens of the motor vehicle headlight lens according to FIG. 2 by way of a perspective view from below.

FIG. 1 shows an example of embodiment of a motor vehicle 1 including a motor vehicle headlight 10. FIG. 2 shows a side view of the motor vehicle headlight 10 including a headlight lens 100, but without a housing, fittings and energy supply, with the headlight lens 100 being represented in FIG. 3 in a cut-out manner by way of a perspective bottom view (view from below). The headlight lens 100 comprises a blank-molded monolithic body of inorganic glass, in particular glass, which comprises 0.2 to 2% by weight $Al_2O_3$,
0.1 to 1% by weight $Li_2O$,
0.3 (in particular 0.4) to 1.5% by weight $Sb_2O_3$,
60 to 75% by weight $SiO_2$,
3 to 12% by weight $Na_2O$,
3 to 12% by weight $K_2O$, and
3 to 12% by weight CaO.

The blank-molded monolithic body comprises a light tunnel 108, which, on its one side, has a light entry face 101 and, on another side, passes over into a light passage (or conductive) section 109 (of the blank-molded monolithic body) via a bend 107 curved in two spatial directions, which section 109 includes a light exit face 102, a light entry face 103 as well as a further light exit face 104. The headlight lens 100 is configured such that light entering the headlight lens 100 through the light entry face 101 and, in the region of the bend 107, entering the passage section from the light tunnel 108 will exit from the light exit face 104 essentially in parallel to the optical axis 120 of the headlight lens 100. In this context, the light passage section 109 images the bend 107 as a light (or bright)/dark-boundary. A portion of the surface of the light passage section 109 facing the light tunnel 108 is configured as a Petzval surface, said surface portion having been designated by reference numeral 110.

The motor vehicle headlight 10 includes a light source 11 configured as an LED and a light source 12 configured as an LED. For the purpose of implementing a dipped-beam headlights, light is irradiated into or made to enter (coupled into), respectively, the light entry face 101 of the light tunnel 108 by means of the light source 11. By means of the light source 12, which may be switched-on alternatively for implementing a sign light or a high-beam headlight, light is introduced (made to enter or coupled into) or irradiated, respectively, into a bottom side of the light tunnel 108 or into the portion 110, respectively, of the surface of the light passage section 109 facing the light tunnel 108, which portion 110 is configured as a Petzval surface.

Figure 4:
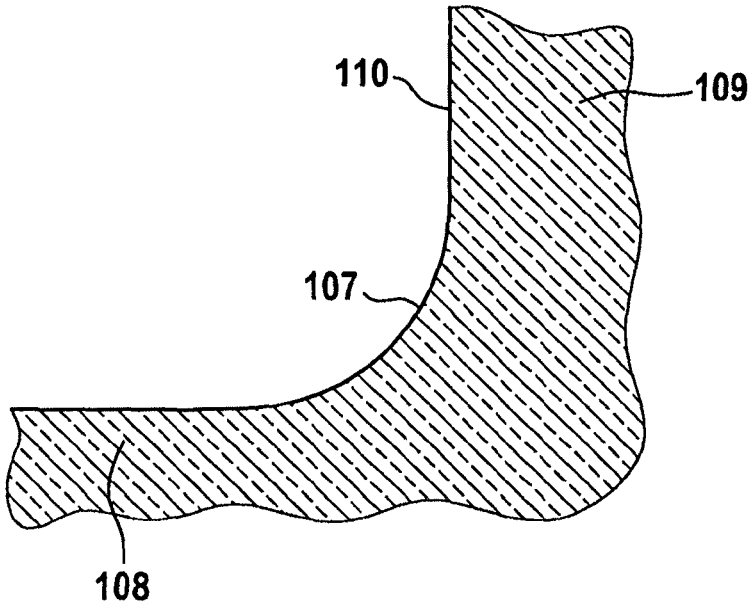
FIG. 4 shows an enlarged representation of a cut-out cross section of a bend for the transition of a light tunnel into a passage section of a headlight lens according to FIG. 3.

FIG. 4 shows, by way of an enlarged representation, a cut-out of the bend 107 for a passing over (transiting) of the light tunnel 108 into the light passage section 109, the bend 107 being formed by blank-molding and configured as a continuous, curved transition.

Figure 5:
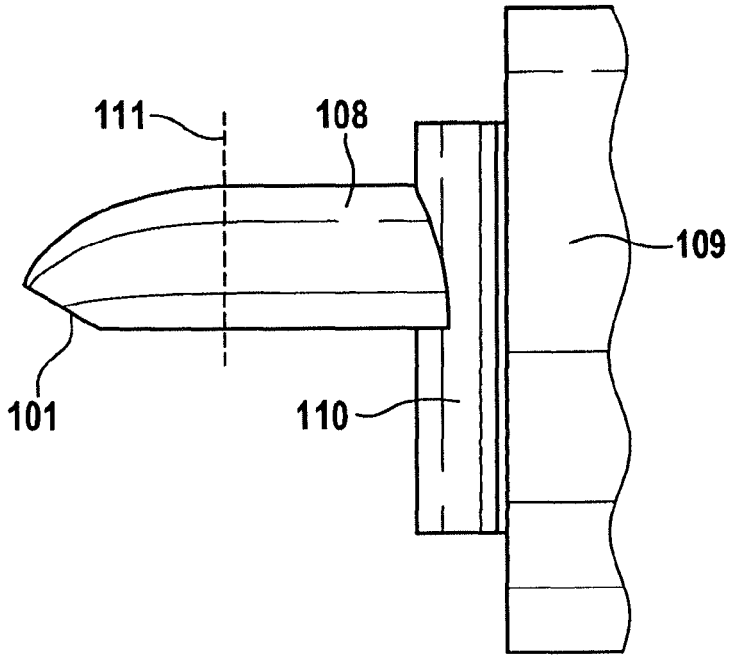
FIG. 5 shows a cut-out representation of a headlight lens according to FIG. 3 by way of a side view.
Figure 6:
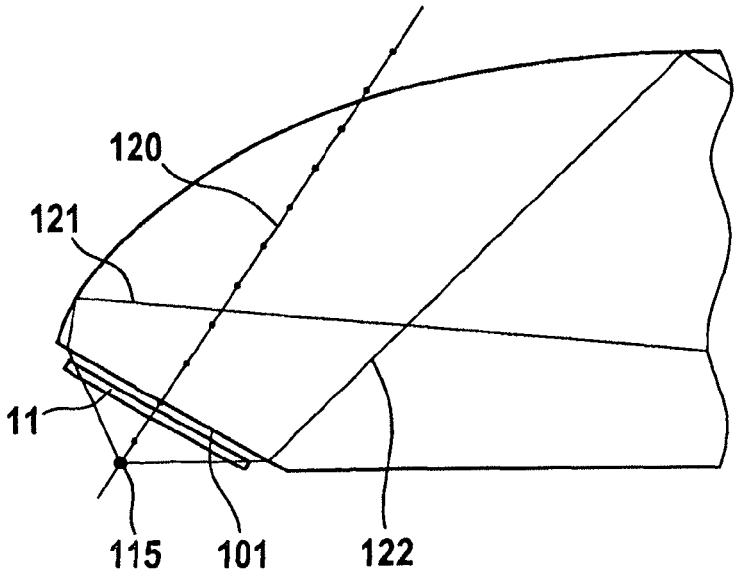
FIG. 6 shows a cut-out representation of a light tunnel of the headlight lens of FIG. 3 by way of a side view.
Figure 7:
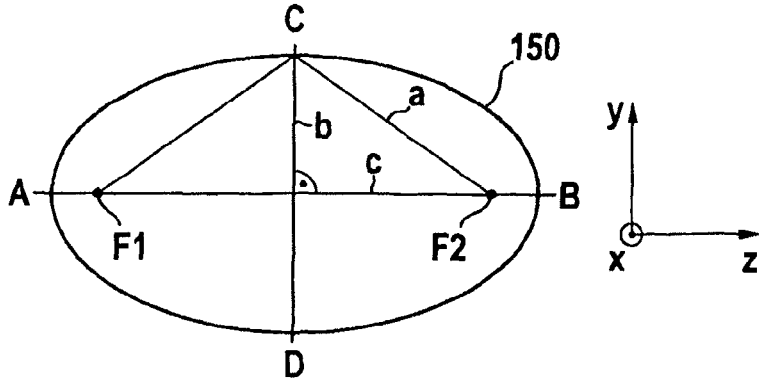
FIG. 7 shows an example of embodiment regarding an ellipsoid.
Figure 8:
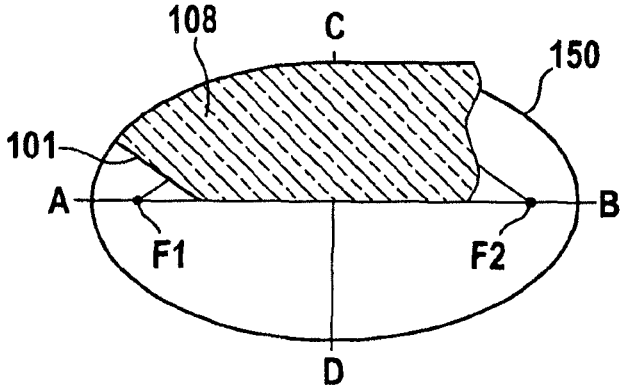
FIG. 8 shows the ellipsoid according to FIG. 7 with superimposed representation of a portion of the light tunnel represented in FIG. 6 by way of a cross sectional representation.

FIG. 5 shows a cut-out representation of a side view of the headlight lens 100. FIG. 6 shows an enlarged cut-out representation of a part of the light tunnel 108 up to the dotted line in FIG. 5 designated by reference numeral 111. The upper portion of the part of the light tunnel as shown in FIG. 6 has been configured as an ellipsoid 150 as represented in FIG. 7. Herein, the dotted line 111 approximately corresponds to the axis C-D. For clarifying this embodiment, a part of the cross section of the light tunnel 108 in FIG. 8 is shown in a manner superimposing (overlaying) the representation of the ellipsoid 150. For the ellipsoid 150 represented in FIG. 7 the following applies:

$$\frac{x^2}{a^2} + \frac{y^2}{b^2} + \frac{z^2}{c^2} - 1 = 0$$

Herein, there is z a coordinate in the direction of the optical axis of the light tunnel (A→B);

x a coordinate orthogonal to the direction of the optical axis of the light tunnel; and y a coordinate orthogonal to the direction of the optical axis of the light tunnel and to the x-direction (D→C).

a, b and, consequently, c have been chosen such that all light beams or rays which pass through focus F1 will concentrate again in focus F2 after mirroring in the surface of the ellipsoid. The course of the beams of light from the light source 11, which is irradiated into or made to enter (coupled into) the light entry face 101, respectively, is clearly illustrated by the light beams 121 and 122 depicted in FIG. 6. Reference numeral 120 of FIG. 6 designates the orthogonal of the light entry face 101. The mutual point of intersection of the orthogonal 120 of the light entry face 101 with the light beams 121 and 122 has been designated by reference numeral 115. The position of this point of intersection 115 corresponds to focus F1 in FIG. 7 and FIG. 8.

Figure 9:
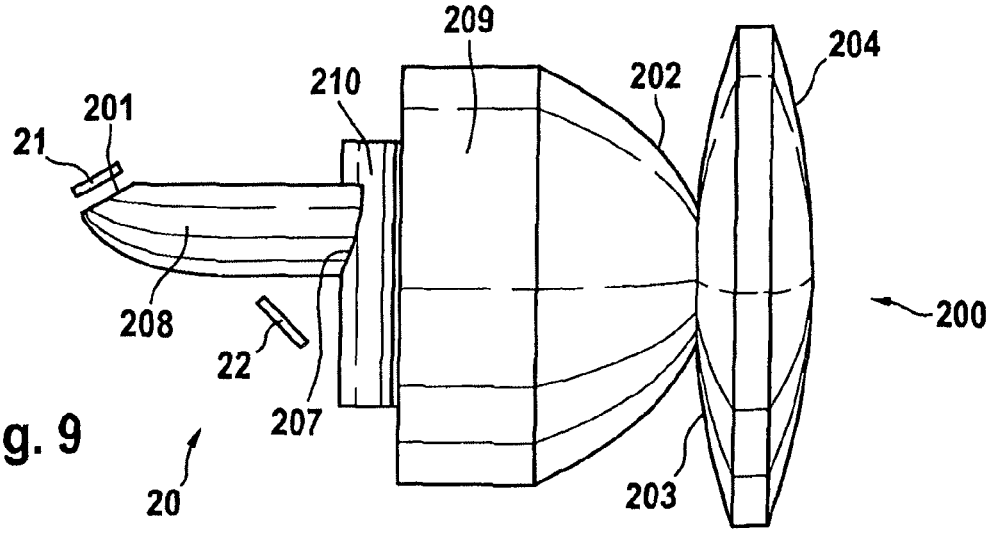
FIG. 9 shows a side view of an alternative example of embodiment of a motor vehicle headlight (for use in the motor vehicle according to FIG. 1)

FIG. 9 shows a side elevation of a motor vehicle headlight 20 to be used alternatively with regard to motor vehicle headlight 10. The motor vehicle headlight 20 comprises a headlight lens 200. The headlight lens 200 comprises a blank-molded monolithic body of inorganic glass including a light tunnel 208, which has a light exit face 201 on one side and, on the other side, passes over/transits into a light passage or conductive section 209 (of the blank-molded monolithic body) via a bend 207 curved in the three spatial dimensions, which light passage section 209 includes a light exit face 202, a light entry face 203, as well as a further light exit face 204. The headlight lens 200 is shaped such that light which enters the headlight lens 200 through the light entry face 201 and from the light tunnel 208 enters the passage section in the region of the bend 207, will exit from the light exit face 204 essentially in parallel to the optical axis of the headlight lens 200. Herein, the light passage section 209 images the bend 207 as a light-dark-boundary. A portion of the surface of the light passage section 209 designated by reference numeral 210 and facing the light tunnel 208 is shaped as a Petzval surface.

The motor vehicle headlight 20 includes a light source 21 configured as an LED, and a light source 22 configured as an LED. By means of light source 21, and for the purpose of implementing a dipped-beam headlight, light is irradiated into or made to enter (coupled into), respectively, the light entry face 201 of the light tunnel 208. By means of the selectively connectable light source 22, and for implementing sign light or high-beam headlight, light is made to enter or is irradiated, respectively, into a bottom side of the light tunnel 208 or the Petzval-face-configured portion 210, respectively, of the surface of the light passage section 209 facing the light tunnel 208.

FIG. 10 shows a side elevation of a further motor vehicle headlight 30 to be used alternatively with regard to motor vehicle headlight 10. The further motor vehicle headlight 30 comprises a headlight lens 300. FIG. 11 shows the headlight lens 300 by way of a top view, and FIG. 12 shows the headlight lens 300 from the rear. The headlight lens 300 comprises a blank-molded monolithic body of inorganic glass, which body comprises a light tunnel 308, which has a light entry face 301 on one side and, on the other side, passes over (transits) into a light passage or conductive section 309 (of the blank-molded monolithic body) via a bend 207 curved in two spatial dimensions, which light passage section 209 includes a light exit face 302. The headlight lens 300 is configured such that light which enters the headlight lens 300 through the light entry face 301 and, from the light tunnel 308 enters the passage section in the region of the bend 307 will exit from the light exit face 302 essentially in parallel to the optical axis of the headlight lens 300. Herein, the light passage section 309 images the bend 307 as a light-dark-boundary, as has been depicted in FIG. 13. A portion of the surface of the light passage section 309 designated by reference numeral 310 and facing the light tunnel 308 is configured as a Petzval surface. A rim or edge, in particular a circumferential edge, may be arranged on the section designated by reference numeral 330, of the surface of the passage section 309, by means of which section 330 the headlight lens 300 may be fixed in a particularly appropriate manner.

The motor vehicle headlight 30 includes a light source 31 configured as an LED, and a light source 32 configured as an LED. By means of the light source 31, and for the purpose of implementing a dipped-beam headlight, light is irradiated into or made to enter, respectively, the light entry face 301 of the light tunnel 308. By means of the selectively connectable light source 32 for implementing sign light or high-beam headlight, light is made to enter or is irradiated, respectively, into a bottom side of the light tunnel 208 or into the Petzval-surface-configured portion 310 of the surface of the light passage section 309 facing the light tunnel 308, respectively.

Figure 14:
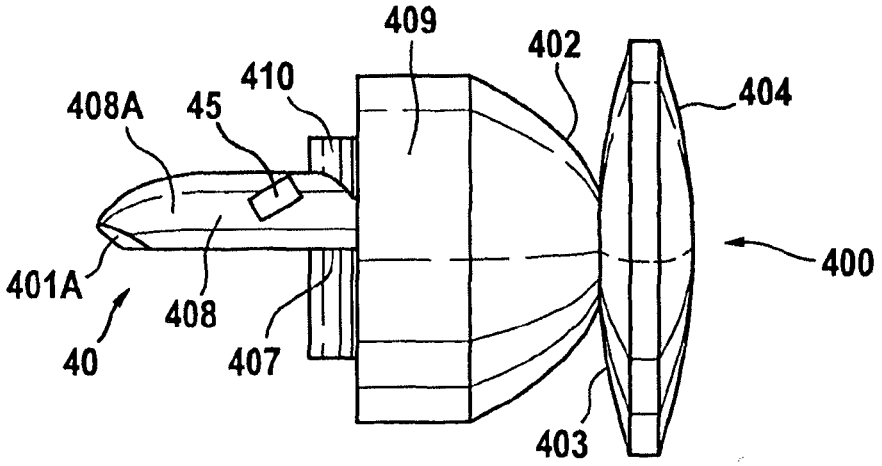
FIG. 14 shows a side view of a further alternative example of embodiment of a motor vehicle headlight (for use in the motor vehicle according to FIG. 1)
Figure 15:
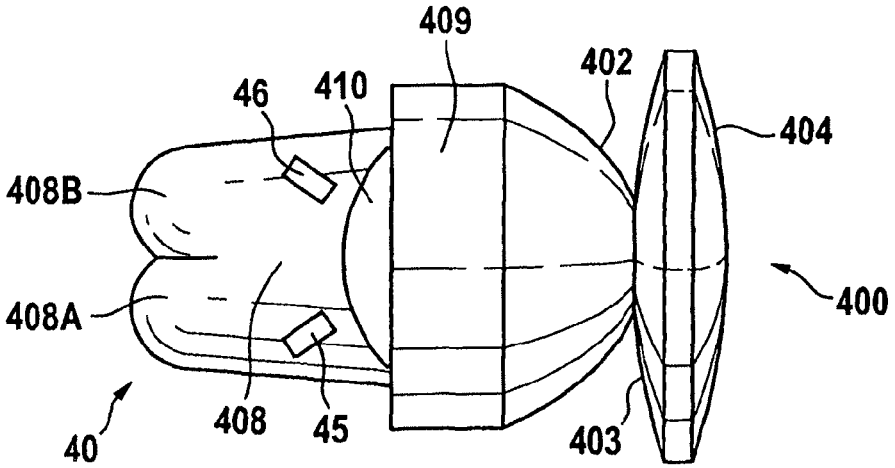
FIG. 15 shows the motor vehicle headlight according to FIG. 14 by way of a top view.
Figure 16:
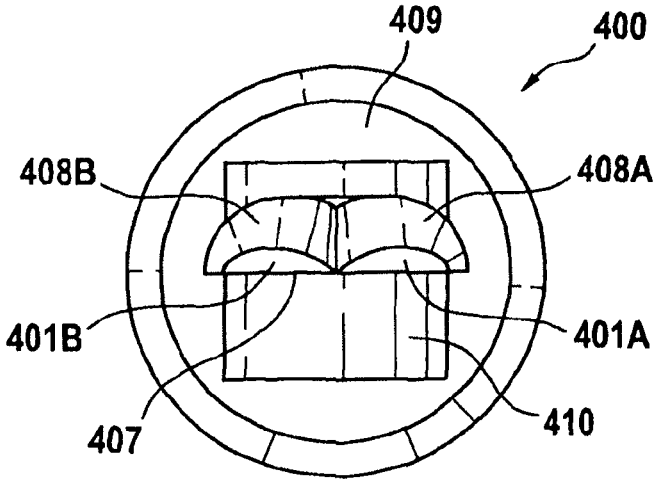
FIG. 16 shows an example of embodiment of the headlight lens of the motor vehicle headlight according to FIG. 14 by way of a rear view.

FIG. 14 shows a further motor vehicle headlight 40 by way of a side elevation and to be used alternatively with regard to motor vehicle headlight 10. The motor vehicle headlight 40 comprises a headlight lens 400. FIG. 15 shows the motor vehicle headlight 40 by way of a top view, and FIG. 16 shows the headlight lens 400 from the rear. The headlight lens 400 comprises a blank-molded monolithic body of inorganic glass, which body comprises a light tunnel section 408A and a light tunnel section 408B, which open out in a light tunnel 408 which, in turn, passes over (transits) to a light passage section 409 (of the blank-molded monolithic body) via a bend 407 curved in two spatial directions, which section 409 includes a light exit face 402, a light entry face 403, as well as a further light exit face 404. The light tunnel section 408A includes a light entry face 401A, and the light tunnel section 408B includes a light entry face 401B. The headlight lens 400 is shaped such that light, which enters the headlight lens 400 through the light entry faces 401A and 401B and, in the region of the bend 407 enters the passage section from the light tunnel 408 will exit from the light exit face 404 essentially parallel to the optical axis of the headlight lens 400. Herein, the light passage section 409 images the bend 407 as a light-dark-boundary. A portion of the surface of the light passage section 409 designated by reference numeral 410 and facing the light tunnel 408 is shaped as a Petzval surface.

Figure 17:
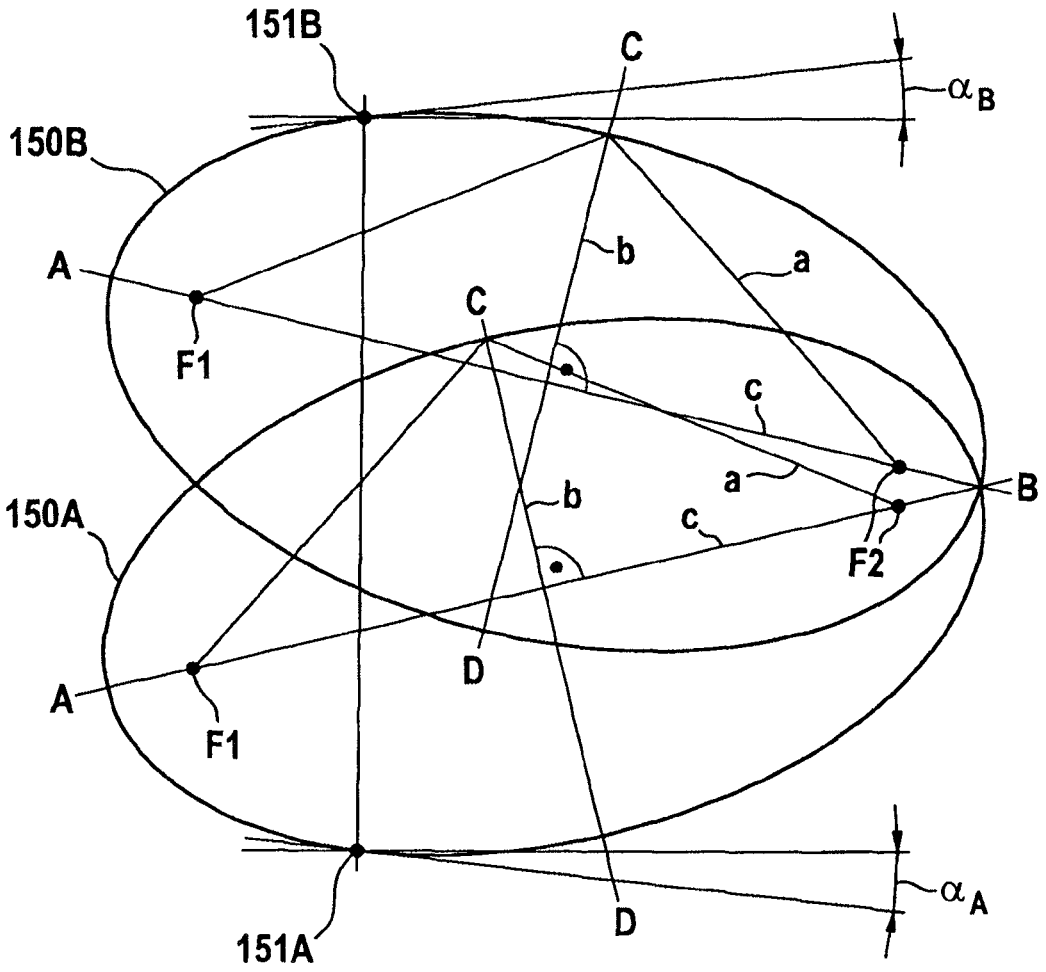
FIG. 17 shows a principle representation of an example of embodiment regarding the superimposition of two ellipsoids.

At least in their upper region, the light tunnel sections 408A and 408B are configured—taken in analogy to the explanations relating to FIG. 6—as part of an ellipsoid, as has been represented in principle in FIG. 17. Herein, reference numeral 150A designates an ellipsoid associated with the light tunnel section 408A, and reference numeral 150B designates an ellipsoid associated with the light tunnel section 408B. The ellipsoids 150A and 150B are, as has been represented in FIG. 17, aligned in relation to each other such that the respective focuses F2 will lie on top of each other. At the points designated by reference numerals 151A and 151B or starting at points 151A and 150B (in the direction of light propagation or towards the right, respectively), respectively, the surface contour of the headlight lens 400 deviates from the contour of an ellipsoid. Herein, the angles $\alpha_A$ and $\alpha_B$ indicate the directions of deviation from the elliptic shape.

The motor vehicle headlight 40 includes two light sources, which, in analogy to light source 11 have been configured as LEDs and have not been depicted in FIG. 14 and FIG. 16 for the sake of clarity. By means of one of the light sources, and for the purpose of implementing a dipped-beam headlight, light is irradiated into or made to enter, respectively, the light entry face 401A of the light tunnel section 408A, and by means of the other one of the light sources, and for the purpose of implementing a dipped-beam headlight, light is irradiated into or made to enter, respectively, the light entry face 401B of the light tunnel section 408B. In addition, a non-shown the light source may be provided, which corresponds to light source 12 with respect to position and performance.

In addition, and for implementing a corner light and/or a front fog light (adverse weather lamp) light sources 45 and 46 configured as LEDs are provided, with the light sources 45 and 46 being adapted to be switched-on or connected alternatively for implementing the corner light. Herein, a non-shown control is provided for within the motor vehicle 4, by means of which the control light source 45 is connected for the time of driving round a left corner, and light source 46 is switched-on for the time of driving round a right corner. For implementing a front fog light, either light source 46 or both light sources 45 and 46 are switched on.

Figure 18:
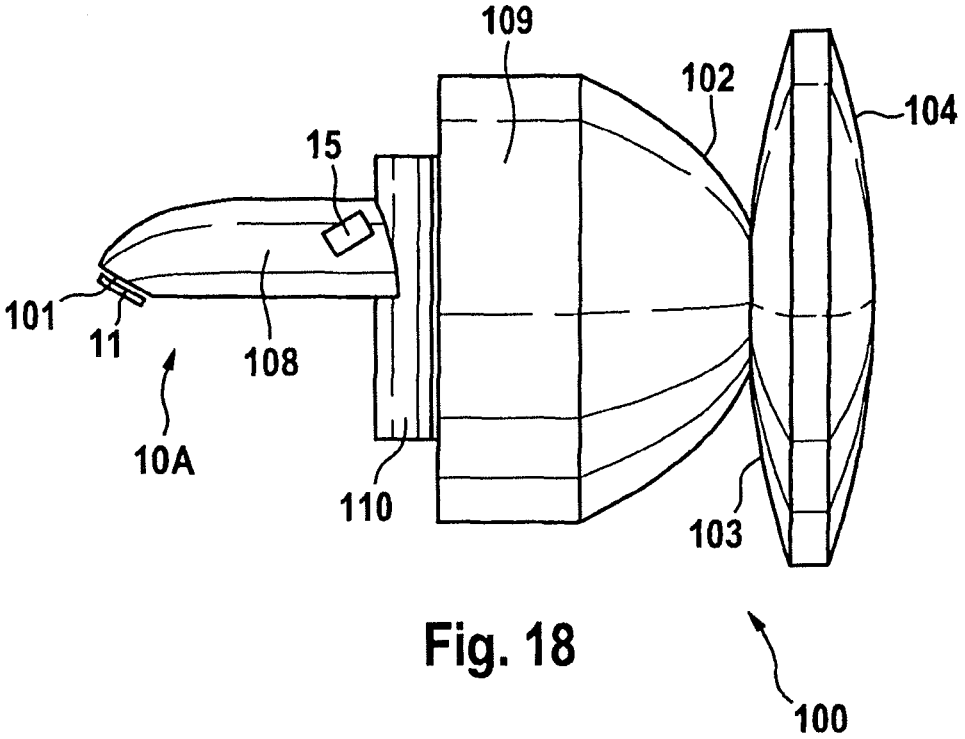
FIG. 18 shows a side view of a further example of embodiment of a motor vehicle headlight for use in the motor vehicle according to FIG. 1.
Figure 19:
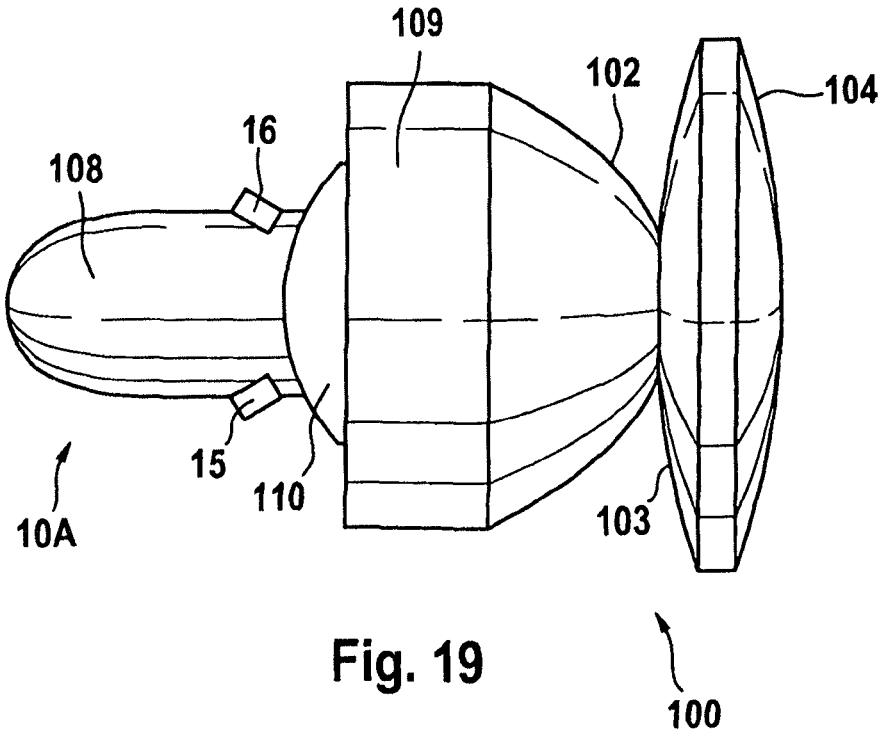
FIG. 19 shows the motor vehicle headlight according to FIG. 18 by way of a top view.

FIG. 18 and FIG. 19 show a motor vehicle headlight lens 10A to be used alternatively with regard to motor vehicle headlight 10. Herein, FIG. 18 shows a side elevation of the motor vehicle headlight lens 10A, and FIG. 19 shows a top view of the motor vehicle headlight lens 10A. The motor vehicle headlight lens 10A comprises the headlight lens 100 as well as the light source 11. In addition, for implementing a corner (or curve) light and/or a front fog light, light sources 15 and 16 configured as LEDs have been provided for. It may as well be provided for that, in addition, the light source 12 is implemented within the motor vehicle headlight 10A.

For implementing a corner light the light sources 15 and 16 may be switched-on alternatively. In this context, a non-shown control is provided for in the motor vehicle 1, by means of which light source 15 may be switched-on for the time of driving round a left corner and light source 16 may be connected for the time of driving round a right corner. For implementing a front fog light either the light source 16, only, or both light sources 15 and 16 are switched-on.

Figure 20:
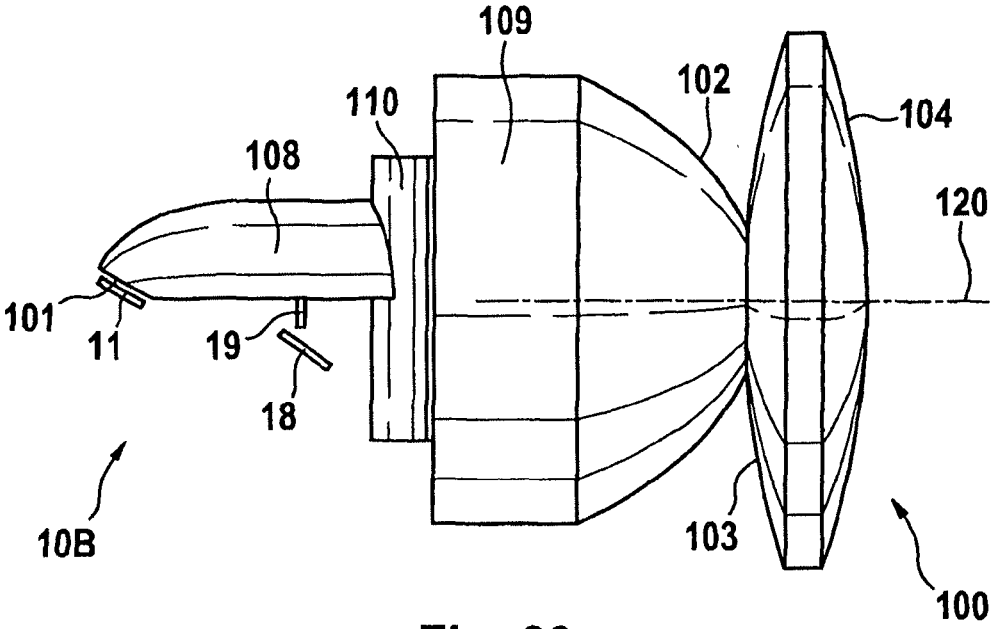
FIG. 20 shows a side view of a further example of an embodiment of a motor vehicle headlight for use in the motor vehicle according to FIG. 1.

FIG. 20 shows a motor vehicle headlight 10B (based on headlight lens 100) to be used alternatively with regard to motor vehicle headlight 10 and provided with a light source 18 adapted to be connected (switched-on) and configured as an LED, for a high-beam headlight function, and with a light source 19 configured as LED, for a sign light function, wherein the light output of the light source 18 is higher than that of light source 19.

Figure 21:
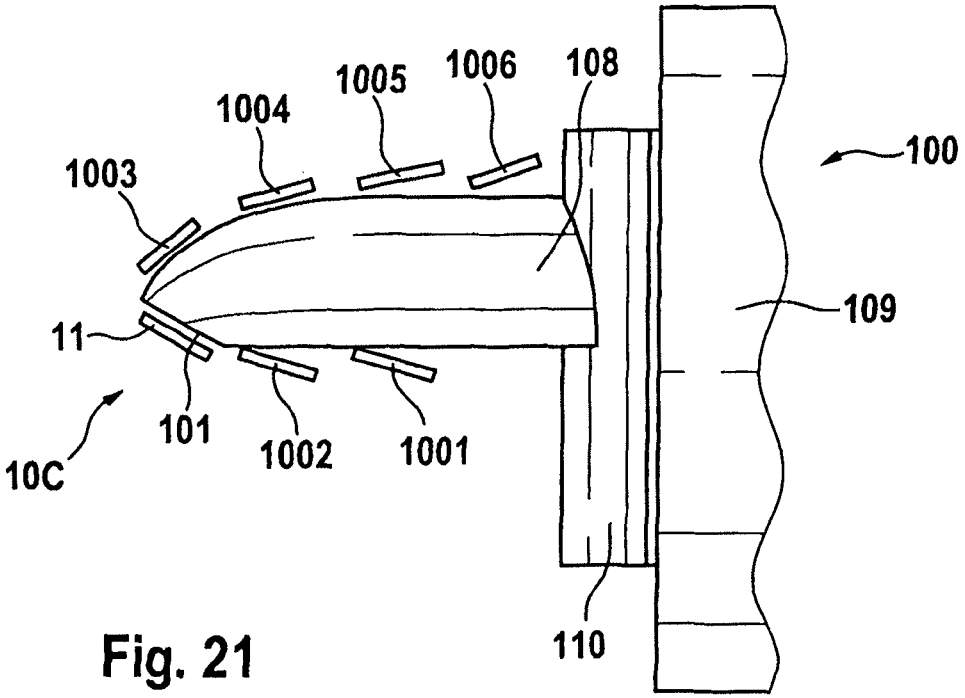
FIG. 21 shows a cut-out side elevation of a further example of embodiment of a motor vehicle headlight for use in the motor vehicle according to FIG. 1.

FIG. 21 shows a further alternative embodiment of a motor vehicle headlight 10C on the base of headlight lens 100. Herein, additional light sources 1001, 1002, 1003, 1004, 1005, 1006 are provided along the light tunnel 108. By means of this arrangement a higher light output may be achieved. The light sources 1003, 1004, 1005, 1006 or one or several of the light sources 1003, 1004, 1005, 1006 may be provided in context with the motor vehicle headlight 10B as well.

FIG. 22 shows a further alternative of a motor vehicle headlight 10D based on the headlight lens 100. FIG. 23 shows the motor vehicle headlight 10 D from the rear, however, without the light source 11. Herein, light is made to enter the Petzval-face-configured surface 110 of the passage section 109 by means of an LED array 1010, whose components may be individually controlled or connected, respectively.

Figure 24:
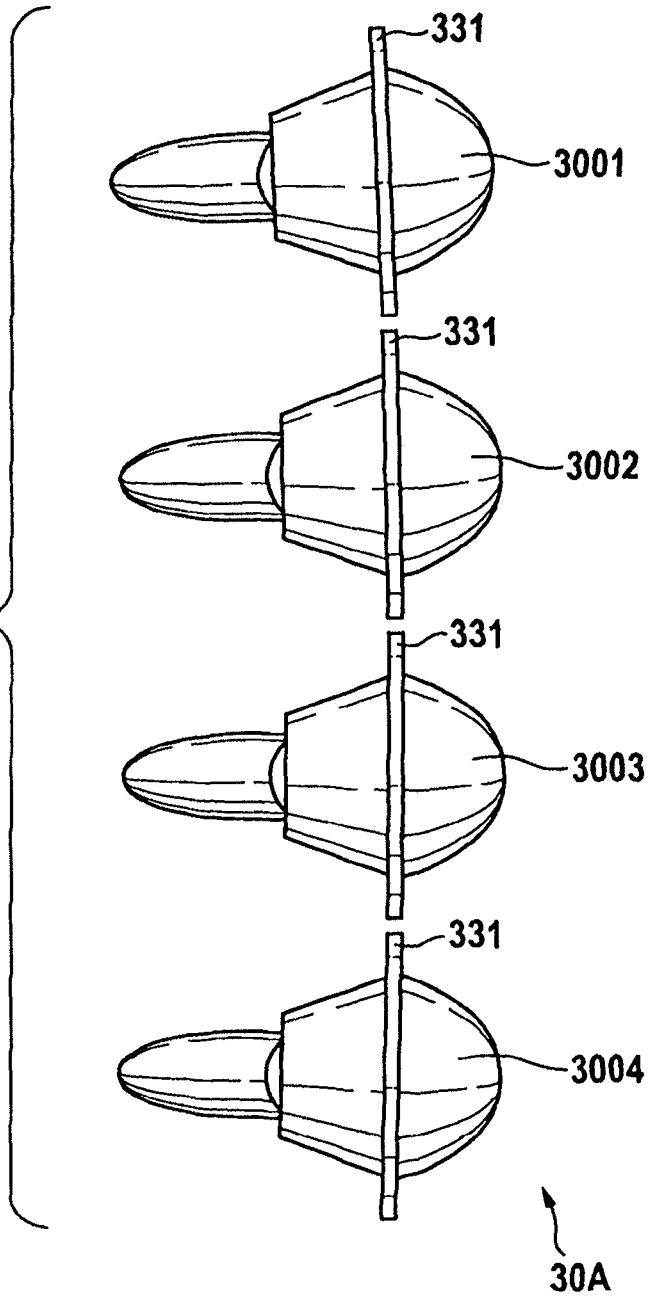
FIG. 24 shows a top view of a further example of embodiment of a motor vehicle headlight for use in the motor vehicle according to FIG. 1.
Figure 25:
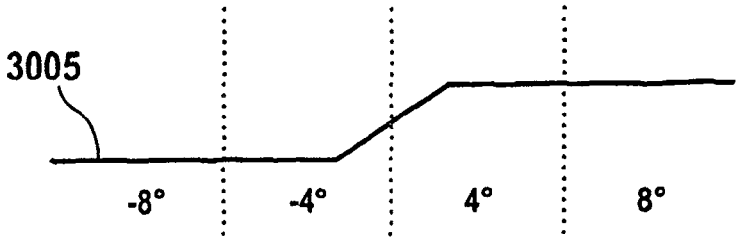
FIG. 25 shows a light-dark-boundary generated by means of the motor vehicle headlight according to FIG. 24.
Figure 26:
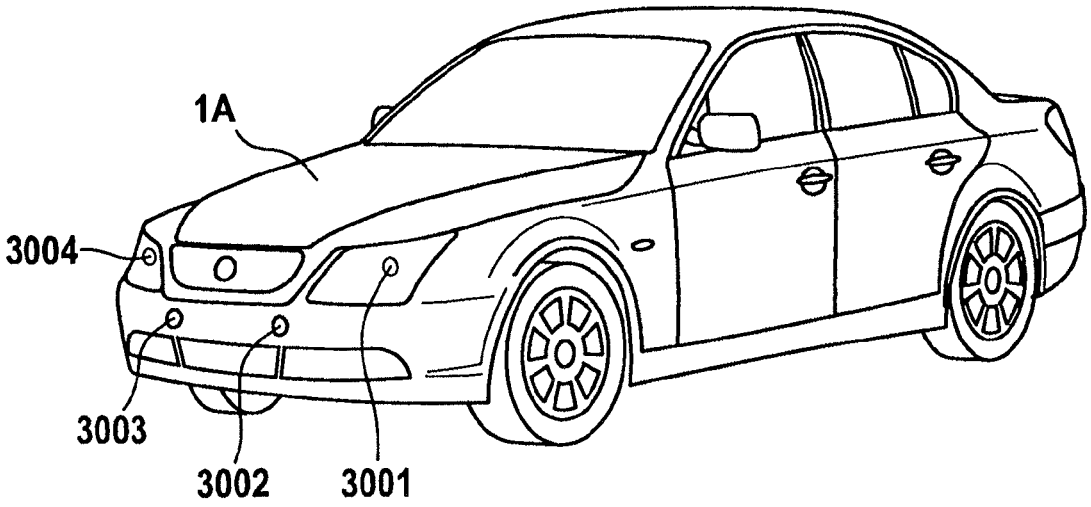
FIG. 26 shows a further example of an embodiment of a motor vehicle.
Figure 27:
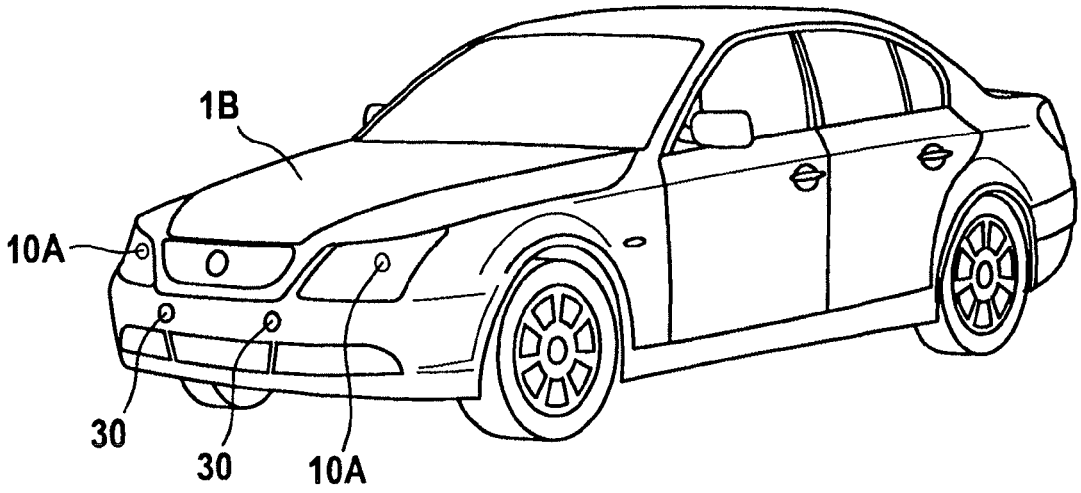
FIG. 27 shows a further example of an embodiment of a motor vehicle.

FIG. 24 shows a top view of a further example of embodiment of an alternatively applicable motor vehicle headlight 30A. The motor vehicle headlight 30A includes partial headlights designated by reference numerals 3001, 3002, 3003, and 3004, which have headlight lenses configured in analogy to headlight lens 300, each, however, including a circumferential rim or edge 331 with differently configured bends, so that the light-dark-boundary 3005 represented in FIG. 25 may be generated. It may be provided for that the partial headlights 3001, 3002, 3003, and 3004 may have LED arrays corresponding to LED array 1010. The optical axes of the partial headlights 3001, 3002, 3003, and 3004 are slightly inclined with respect to each other so that the partial headlight 3001 illuminates essentially the −8°-region, the partial headlight 3002 illuminates essentially the −4°-region, the partial headlight 3003 illuminates essentially the 4°-region, and the partial headlight 3004 illuminates essentially the 8°-region (cf. FIG. 25). It may be provided for that the partial headlights 3001, 3002, 3003, and 3004 be fixedly connected to each other within a module. It may be provided for that the partial headlights 3001, 3002, 3003, and 3004 be arranged in a mutual housing. It may also be provided for that the partial headlights 3001, 3002, 3003, and 3004 as well as further corresponding partial headlights be arranged along the circumference of a geometrical figure, in particular along a circle. It may be provided for that the partial headlights 3001, 3002, 3003, and 3004, are arranged, as has been represented in FIG. 26, within a motor vehicle 1A. FIG. 27 shows a further example of embodiment of a motor vehicle 1B.

Figure 28:
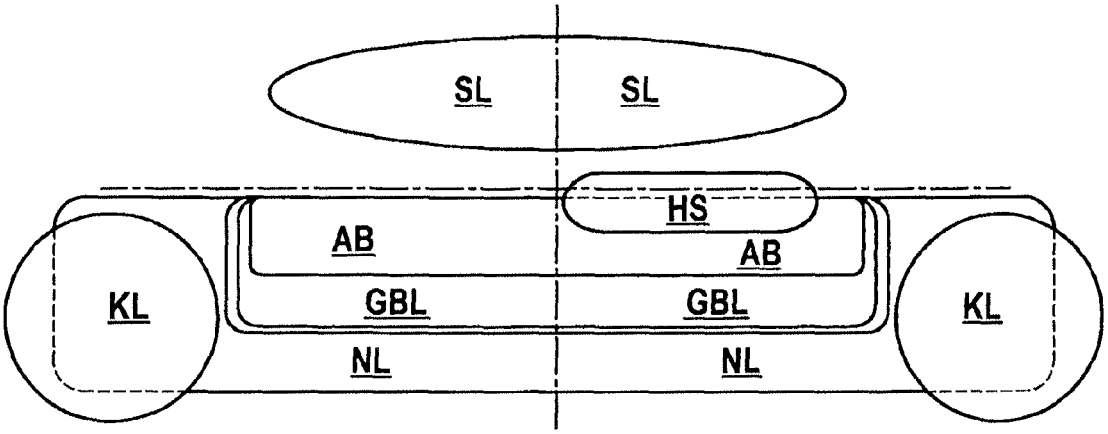
FIG. 28 shows a light distribution, which, for example, may be achieved with the motor vehicle headlights mentioned before.
Figure 29:
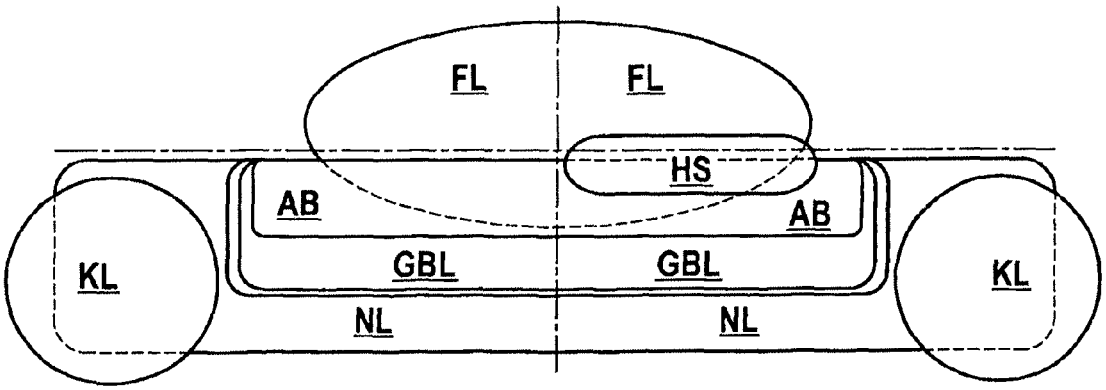
FIG. 29 shows a further light distribution, which, for example, may be achieved with the motor vehicle headlights mentioned before.

FIG. 28 and FIG. 29 show distributions of illumination which, purely by way of example, may be achieved with the aforementioned motor vehicle headlights. Herein, the left area is illuminated by motor vehicle headlights at the positions of partial headlights 3001 and 3002 according to FIG. 26, and the right area is illuminated by the motor vehicle headlights at the positions of the partial headlights 3003 and 3004 according to FIG. 26. In FIG. 28 and FIG. 29, the following reference characters designate the following (light functions): AB the dipped-beam headlight, HS a hotspot, GBL the basic illumination, SL sign light, NL fog light, KL corner light, and FL high-beam headlight.

For example, it has been provided for that dipped-beam headlight, hotspot and basic illumination may be implemented together in connection with a headlight lens (e.g. headlight lens 100 or 200) by means of a light source 11 or 21. It may, however, also be provided for that dipped-beam headlight, hotspot and basic illumination be implemented partially in connection with different headlight lenses (e.g. headlight lens 100 or 200) by means of a light source 11 or 21. It may e.g. be provided for that fog light is implemented in connection with a further headlight lens (e.g. headlight lens 100 or 200) by means of a light source 11 or 21. It is e.g. provided for that sign light is implemented by means of a light source 18 or 19. It is e.g. provided for that high-beam headlight is implemented by means of a light source 19 or 18. It is e.g. provided for that corner (or curve) light is implemented by means of a light source 15 or 16, respectively. The following table shows examples of embodiment for partitioning the areas for the right half (wherein a "+" indicates the illumination of an area):

| | | AB + HS | GBL | SL | NL | KL | FL |
|---|---|---|---|---|---|---|---|
| Example 1 | "Position 3004" | + | | + | | + | |
| | "Position 3003" | | + | | | | + |
| Example 2 | "Position 3004" | + | | + | | | |
| | "Position 3003" | | + | | | + | + |
| Example 3 | "Position 3004" | + | + | + | | + | |
| | "Position 3003" | | | | + | | + |
| Example 4 | "Position 3004" | + | + | | | + | + |
| | "Position 3003" | | | + | + | | |
| Example 5 | "Position 3004" | + | + | + | | | |
| | "Position 3003" | | | | + | + | + |
| Example 6 | "Position 3004" | + | + | | | | + |
| | "Position 3003" | | | + | + | + | |
| Example 7 | "Position 3004" | + | | + | + | + | |
| | "Position 3003" | | + | | | | + |
| Example 8 | "Position 3004" | + | | + | + | | |
| | "Position 3003" | | + | | | + | + |
| Example 9 | "Position 3004" | + | | | + | + | + |
| | "Position 3003" | | + | + | | | |
| Example 10 | "Position 3004" | + | | | + | | + |
| | "Position 3003" | | + | + | | + | |

The elements, distances and angles in the figures have been drawn in consideration of simplicity and clearness and not necessarily to scale. For example, the orders of magnitude of some elements, distances and angles have been exaggerated with respect to other elements, distances and angles in order to improve comprehension of the example of embodiment of the present invention.

The invention claimed is:

1. Vehicle headlight including:

a first light source;

a headlight lens comprising a monolithic body of transparent material, the monolithic body including:

a light passage section including a optically operative light exit face; and a light tunnel comprising a light entry face, wherein the light tunnel passes over, via a bend, into the light passage section for imaging the bend as a light-dark-boundary by means of light irradiated from the first light source into the light entry face; and at least a second light source spatially separated from the first light source, the second light source being configured for irradiating light directly into the light passage section without passing through the light tunnel.

2. The vehicle headlight of claim 1 being configured that light irradiated by means of the second light source is irradiated above the light-dark-boundary.

3. The vehicle headlight of claim 2, wherein the second light source includes at least one partial light source arranged below the light tunnel.

4. The vehicle headlight of claim 1, wherein the second light source includes at least one partial light source arranged below the light tunnel.

5. The vehicle headlight of claim 2, wherein the second light source includes at least two partial light sources spatially separated from one another and arranged below the light tunnel.

6. The vehicle headlight of claim 1, wherein the second light source includes at least two partial light sources spatially separated from one another and arranged below the light tunnel.

7. The vehicle headlight of claim 2, the second light source being arranged between the light entry face and the light passage section.

8. The vehicle headlight of claim 1, the second light source being arranged between the light entry face and the light passage section.

9. Vehicle headlight including:

a first light source;

a headlight lens comprising a monolithic body of transparent material, the monolithic body including:

a light passage section including a optically operative light exit face; and a light tunnel comprising a light entry face, wherein the light tunnel passes over, via a bend, into the light passage section for imaging the bend as a light-dark-boundary by means of light irradiated from the first light source into the light entry face; and at least a second light source spatially separated from the first light source, the second light source being configured for irradiating light into a surface of the light passage section, said surface facing the light tunnel.

10. The vehicle headlight of claim 9 being configured that light irradiated by means of the second light source is irradiated above the light-dark-boundary.

11. The vehicle headlight of claim 10, wherein the second light source includes at least one partial light source arranged below the light tunnel.

12. The vehicle headlight of claim 9, wherein the second light source includes at least one partial light source arranged below the light tunnel.

13. The vehicle headlight of claim 10, wherein the second light source includes at least two partial light sources spatially separated from one another and arranged below the light tunnel.

14. The vehicle headlight of claim 9, wherein the second light source includes at least two partial light sources spatially separated from one another and arranged below the light tunnel.

15. The vehicle headlight of claim 10, the second light source being arranged between the light entry face and the light passage section.

16. The vehicle headlight of claim 9, the second light source being arranged between the light entry face and the light passage section.

17. Vehicle headlight including:

a first light source;

a headlight lens comprising a monolithic body of transparent material, the monolithic body including:

a light passage section including a optically operative light exit face; and a light tunnel comprising a light entry face, wherein the light tunnel passes over, via a bend, into the light passage section for imaging the bend as a light-dark-boundary by means of light irradiated from the first light source into the light entry face for implementing a dipped-beam headlight; and at least a second light source spatially separated from the first light source and arranged between the light entry face and the light passage section, the second light source being configured for irradiating light into the light tunnel.

18. The vehicle headlight of claim 17, for implementing a corner light, the second light source including a first corner light source arranged to the left of an optical axis of the light tunnel.

19. The vehicle headlight of claim 18, the first corner light source being arranged above the optical axis of the light tunnel.

20. The vehicle headlight of claim 19, the first corner light source being arranged between the light entry face and the light passage section.

21. The vehicle headlight of claim 18, the first corner light source being arranged between the light entry face and the light passage section.

22. The vehicle headlight of claim 18, the second light source including a second corner light source arranged to the right of the optical axis of the light tunnel.

23. The vehicle headlight of claim 22, the second corner light source being arranged above the optical axis of the light tunnel.

24. The vehicle headlight of claim 23, the second corner light source being arranged between the light entry face and the light passage section.

25. The vehicle headlight of claim 22, the second corner light source being arranged between the light entry face and the light passage section.

* * * * *